United States Patent [19]

Petros

[11] 4,202,198

[45] May 13, 1980

[54] STRIP MILL ENTRY GUIDES AND METHOD OF CLAMPING WORKPIECE THEREIN

[75] Inventor: Andrew J. Petros, Oakdale, Pa.

[73] Assignee: Mesta Machine Company, Pittsburgh, Pa.

[21] Appl. No.: 956,176

[22] Filed: Oct. 30, 1978

[51] Int. Cl.[2] ..... B21B 37/16

[52] U.S. Cl. ..... 72/250

[58] Field of Search ..... 72/250, 227

[56] References Cited

U.S. PATENT DOCUMENTS

| | | | |
|---|---|---|---|
| 3,058,376 | 10/1962 | Fry | 72/250 |
| 3,071,032 | 1/1963 | Teplitz | 72/250 |
| 3,406,553 | 10/1968 | Gross et al. | 72/250 X |
| 3,438,474 | 4/1969 | Tedeschi | 72/250 X |
| 3,614,881 | 10/1971 | Petros | 72/250 |
| 3,740,989 | 6/1973 | Petros | 72/250 |

*Primary Examiner*—Milton S. Mehr

*Attorney, Agent, or Firm*—Carothers and Carothers

[57] ABSTRACT

A strip mill entry guide mechanism having upper and lower platens positioned to receive and clamp strip material passing therebetween. One of the platens is driven by a first drive mechanism toward the other platen into clamping engagement with the strip. This first drive mechanism is locked in this clamping position to prevent its forced retraction therefrom while this same driven platen is further driven into heavier clamping engagement with the moving strip with a second drive mechanism disposed between the locked first said drive mechanism and the platen being driven.

17 Claims, 2 Drawing Figures

STRIP MILL ENTRY GUIDES AND METHOD OF CLAMPING WORKPIECE THEREIN

BACKGROUND OF THE INVENTION

The present invention relates to entry guides for a strip mill and more particularly to entry guides of the character described which are usually employed at each mill stand to guide the lead end of the strip to the bite of the work rolls and to clamp the moving strip when tailing-out and provide strip tension or mill entry tension in a tandem strip mill to minimize tail-end slap.

A very important function of mill entry guides is to restrain the moving strip as the mill finishes rolling a coil and the strip tail-end drops out of the previous mill stand rolls. Previous arrangements of such entry guides have been found to be deficient because they do not provide sufficiently high clamping forces on the moving strip, and they are rather complicated structures which are not sufficiently rugged to withstand repeated rigorous tailing-out operations.

Generally strip threaded through a cold reduction mill is advanced by being pushed by the previous mill stand or a driven pinch roll. Strip is fed into the mill guides which have side guides opened slightly wider than the incoming strip width. In addition, some mills have remote controls to move the side guides a fixed distance when threading and tailing-out each coil.

A positioning cylinder assembly lifts the top platen boards to a maximum open position so that the strip head will enter between the guide platens and then the opening is partially closed before the strip enters the roll bite of the mill stand. Side guide adjustment and platen positioning operations keep the head end of the strip on mill center line and guide the strip into the roll bite as the strip is threaded through the mill.

When tailing-out, the guide platens (which are faced with platen boards for frictional engagement with the moving strip) then clamp the moving strip therebetween causing a drag on the strip. This drag restrains the strip and acts as a damper to prevent the strip tail-end from jumping out of control when interstand tension is relieved as the strip tail-end leaves the previous mill stand. When the clamping force of this tailing-out operation is insufficient (as is the case with previous entry guides), proper back tensioning on the tailing-out end of the strip is not provided causing the tail-end of the strip to be improperly rolled, and as much as 150 feet of strip tail-end must be cut off and scrapped. The use of ever increasing mill line speeds magnifies this problem.

The need for ever larger clamping forces has necessitated the use of extremely large air cylinders which are objectionable, as they take up needed valuable space for other equipment and they still do not provide sufficient clamping forces. High pressure hydraulic cylinders are generally not used nor are they desirable as a substitute because of the possibility of hydraulic fluid leaks getting onto the strip and contaminating the rolling solution.

As an example of past practice, bulky 24-inch bore air cylinders or drive means having approximately a 450 square inch effective pressure application area have been utilized for top board or platen positioning in mill guides in addition to clamping, and sufficient clamping forces still are not realized.

Other problems encountered with previous entry guides are over-complication of design and difficult access for service and maintenance. In addition, their designs are such that the nose of the guide cannot extend as close as desired to the roll bite for feeding a lead end of the strip thereto. Also, when board changes must be made on the platens of the mill guides of the prior art, an undesirable amount of time is required for guide board changes.

A principal object of the present invention is to provide a mill entry guide mechanism and method of clamping strip therein which is devoid of the aforementioned problems and disadvantages.

SUMMARY OF THE INVENTION

The mill entry guide mechanism of the present invention includes a support frame with upper and lower platens positioned to receive an elongated workpiece (such as mill strip) therebetween and drive means movably supporting one of the platens from the frame for driven movement toward the other platen to clamp the workpiece therebetween. A second drive means is disposed between the aforesaid first drive means and the said one platen being driven to further drive this platen into heavier clamping engagement with the workpiece after clamping engagement has already been effected by the aforesaid first drive means, while a lock means which extends between this second drive means and the frame is engaged to block the aforesaid first drive means against forced retraction by this second drive means.

Stated a different way, one of the platens of the mill entry guide (generally the top platen) is driven by a first drive mechanism towards the other platen into clamping engagement with the workpiece or strip which is positioned between the platens. This first drive mechanism is then locked in this clamping position to prevent it from being forced to retract due to thereafter additionally applied clamping forces which further drive this same platen into heavier clamping engagement with the strip by a second drive mechanism that is disposed between the locked first drive mechanism and the platen being driven.

This second drive mechanism or means preferably consists of an expansible air chamber into which air is injected under pressure to provide the heavier clamping forces.

Generally, the aforesaid first drive means will be an air cylinder which has smaller driving forces or clamping forces than does this second drive means or expansible air chamber. The air chamber is made shallow and wide such that it has a larger effective pressure application area against the platen being driven than does the first drive means or air cylinder. This arrangement permits the use of a relatively small air cylinder for the first drive means thereby providing easy access for service and maintenance and room for other machinery and equipment. In addition, the expansible air chamber provided for the second drive means provides clamping forces of over 260 percent of that which could be reailized by the bulky single air cylinder utilized in previous mill guides. The air chamber is preferably yieldable to provide a back-up cushioning for the one platen being driven.

In the preferred embodiment, the lock means for preventing forced retraction of the first platen drive means consists of lever arms which pivotally support and guide the movement of the platen in a swing fashion relative to the mill entry guide frame, and these lever arms are positioned such that they are pivoted to locking dead center parallel alignment relative to the direction of the drive force applied by the second drive means generated between the platen and these levers when the platens are in clamping engagement with the strip. This arrangement mechanically blocks the first drive means or cylinder from forced retraction when the second drive mechanism is being driven to further drive the platen into heavier clamping engagement with the strip.

Another feature of the mill entry guide mechanism of the present invention is means to permit quick change of the platen boards. The platen boards are individually retained to their respective platen by a beveled key fit, and a release is provided on the platen to individually unkey and permit removal or insertion of a platen board.

The platen board of at least one of the platens each has two beveled keying surfaces which are spaced from each other and which mate corresponding beveled surfaces on its platen thereby retaining the boards to the platen in a beveled key fashion, and the release mechanism may be operated to temporarily permit displacement of these mating beveled surfaces on the platen for removal and insertion of the board. In one form, the release means may consist of a keeper plate secured to the platen and positioned to engage or retain an end of one of the boards to retain the board in its keyed engagement with its platen. This keeper plate is pivotally movable out of the way to release the board, and the keeper plate is further counterweighted so that under normal conditions it will maintain engagement with or retention of the board.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE DRAWINGS

Figure 1:
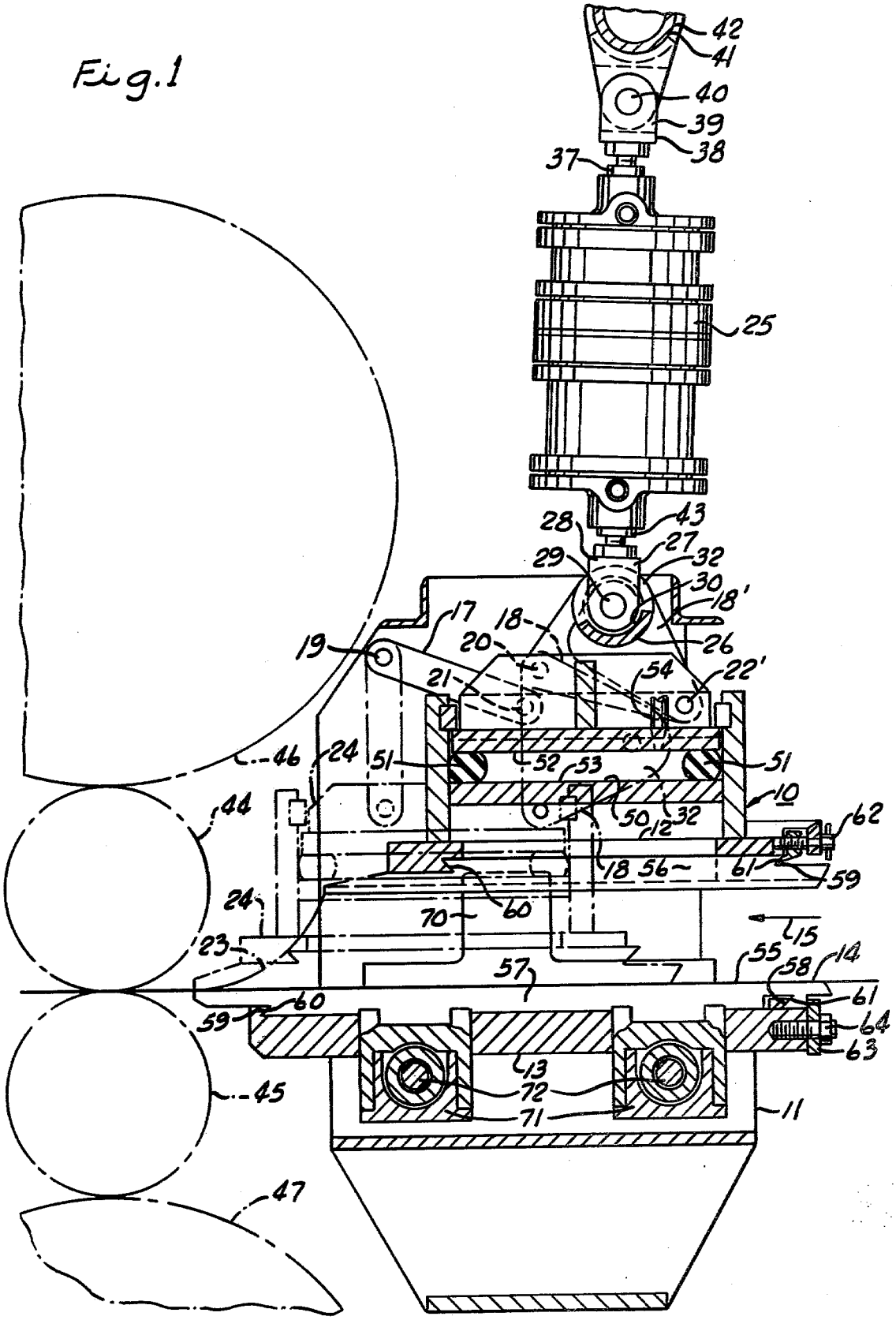
FIG. 1 is a view in side elevation with portions sectioned away for internal viewing of one embodiment of the mill entry guide mechanism of the present invention.
Figure 2:
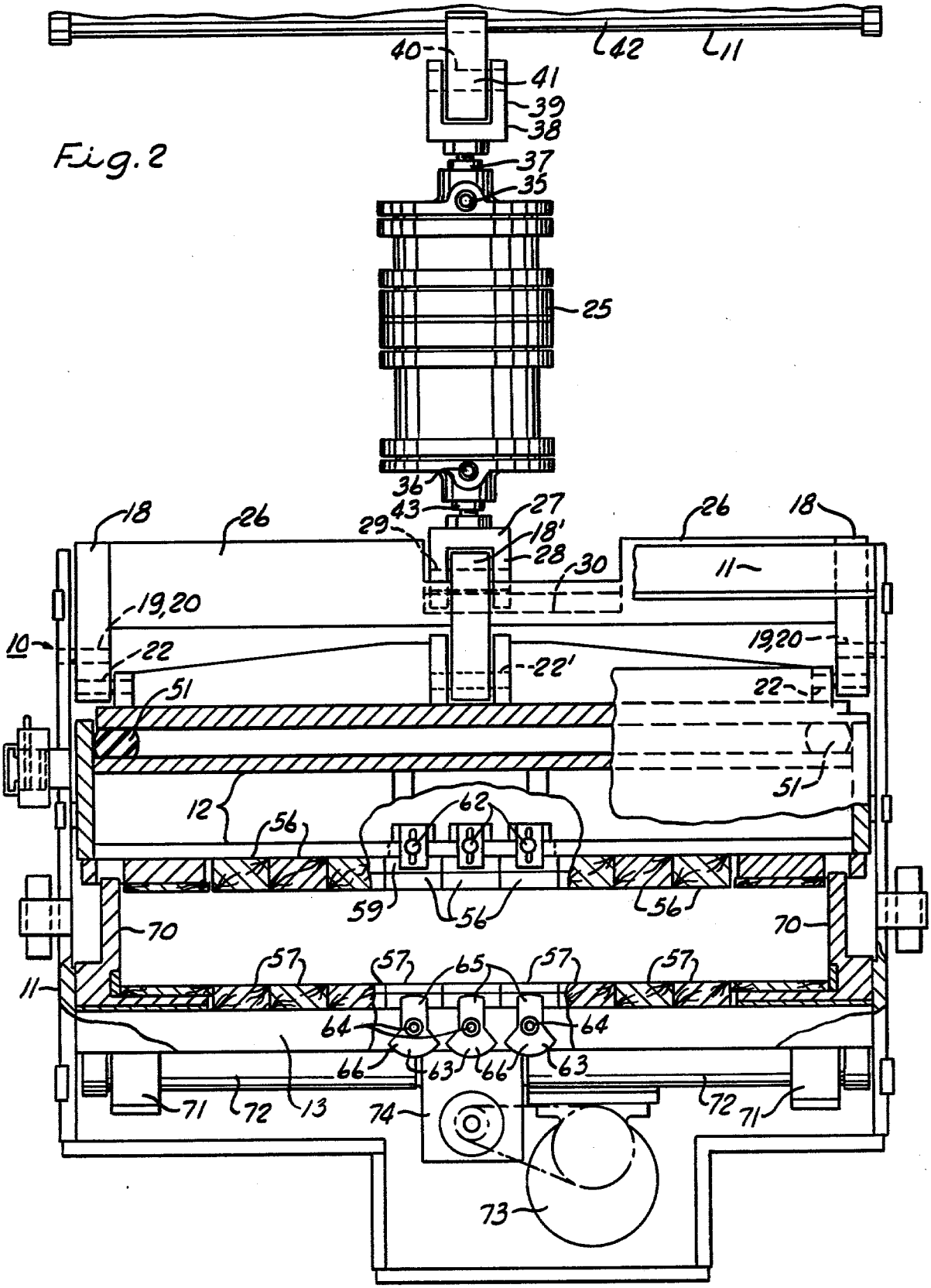
FIG. 2 is a view in end elevation of the mill entry guide mechanism shown in FIG. 1 with portions sectioned away for internal viewing.

Referring to the Figures, the mill entry guide mechanism 10 of the present invention includes a support frame 11 and upper and lower platens 12 and 13 respectively which are supported by frame 11 to receive a moving elongated strip (not shown) passing therebetween along mill pass line 14 in the direction of arrow 15 as seen in FIG. 1.

The upper platen 12 is supported from frame 11 by four equal length lever arms, two lever arms per side. The two lever arms on each side of platen 12 are respectively designated as lever arms 17 and 18. Lever arms 17 and 18 are respectively pivoted from a fixed pivot pin 19 and 20 which are secured to the support frame 11.

The lever arms 17 and 18 have their opposite ends respectively pivotally secured to upper platen 12 by means of pivot pins 21 and 22, which are in turn secured to the upper portion of platen 12. The distance between center points of pivot pins 19 and 21 of lever arm 17 and the distance between the center of pivot pins 20 and 22 of lever arm 18 are equal, and these lever arms support upper platen 12 from frame 11 for guided swing movement along the arcuate path indicated by arcuate chain line 23 from the full open position indicated by the full line position of upper platen 12 in FIG. 1 downwardly to a closed position with upper and lower platens 12 and 13 respectively clamping a moving strip on pass line 14 therebetween as indicated by the phantom chain outline 24.

Upper platen 12 is suspended and driven through this guided swing movement by means of back-to-back drive air cylinder 25. Drive cylinder 25 is connected at its bottom end to upper platen 12 via swing lever arms 18 and central pivot arm 18'. Central pivot arm 18' is rigidly connected with outside lever arms 18 by means of crossbar 26. Thus, lever arms 18 and pviot arm 18' together with connecting crossbar 26 move as a unit and air cylinder 25 is pivotally connected to this unit by a clevis pin arrangement 27. Clevis pin arrangement 27 consists of clevis 28 which is pivotally secured to an ear of pivot lever 18' by pivot pin 29. Clevis 28 is received with clearance in recess 30 of crossbar 26. Pivot arm 18 is in turn pivotally secured to upper platen 12 by means of pivot pin 22' which is axially aligned with pivot pins 22 of lever arms 18. Lever arms 18 are of triangular configuration to provide an ear portion 32 for rigid connection to crossbar 26.

Positioning drive cylinder 25 is a relatively small back-to-back positioning cylinder which is driven by air under pressure through top inlet 35 for driving and retracting the top piston of the cylinder and inlet 36 for driving and retracting the bottom piston of cylinder 25. The top piston of cylinder 25 is provided with piston rod 37 which is threadably secured to clevis and pin assembly 38. Clevis assembly 38 consists of clevis 39 and its pivot pin connection 40 to ear 41. Ear 41 is in turn rigidly connected to cross tube 42 which can be considered an integral part of support frame 11.

The bottom piston of air cylinder 25 is provided with a piston rod 43 which is threadably secured to clevis 28. Back-to-back positioning cylinder 25 is used to provide three operating positions for the upper guide platen or platen assembly 12. The open platen position is illustrated in FIG. 1 in full outline when both cylinders of back-to-back cylinder 25 are retracted. When the bottom or long stroke cylinder of air cylinder 25 is extended, upper platen 12 is positioned to provide a small opening between it and lower platen 13 of approximately an inch for strip head feeding to the mill roll bite provided between mill rolls 44 and 45. Mill rolls 44 and 45 are backed up by conventional back-up rolls 46 and 47 respectively. When the upper short stroke cylinder of air cylinder 25 is also extended, upper platen or platen assembly 12 is driven to its closed position as indicated by phantom chain outline position 24, such that it is in clamping engagement with strip material on mill pass line 14 between upper and lower platens 12 and 13.

A second drive means in the form of expandable air chamber 50 is disposed between drive cylinder 25 and upper platen 12 to further drive upper platen 12 in the closed position shown by phantom outline 24 into heavier clamping engagement with the strip. Air chamber 50 serves as a large yet compact or shallow built-in single acting air cylinder that is sealed by a gasket or resilient endless seal member 51 constructed of a yieldable material such as neoprene. Air chamber 50 is a shallow and wide piston and cylinder arrangement wherein piston 52 defines the top of chamber 50 and cylinder bottom 53 defines the bottom of the air chamber and seal member 51 defines the sides of the air chamber.

Gasket or seal member 51 is initially compressed when the back-to-back positioning cylinder assembly 25 is fully extended for clamping as indicated by phantom outline 24. In this clamping position, the swing levers 17 and 18 assume a vertical position, and the air chamber 50 is then pressurized with air under pressure injected through inlet pipe 54 to create high clamping forces whereby upper platen 12 is driven into heavier clamping engagement with the strip positioned between upper and lower platens 12 and 13.

The toggle effect of the swing levers 17 and 18 being swung to a vertical position transfers the vertical clamping load effected by air chamber 50 to the swing lever pivot pins 19 and 20 instead of to clevis 28 and piston rod 43 thereby mechanically blocking air cylinder 25 from forced retraction due to the much heavier pressures created by air chamber 50.

Thus, swing or lever arms 17 and 18 are positioned and aligned such that when upper platen 12 is in the closed position as indicated by phantom outline 24, the lever arms are aligned at a locking dead center parallel alignment relative to the direction of the drive force applied by air chamber 50 between upper platen 12 and levers 17 and 18. Thus, when drive means or air chamber 50 is driven, cylinder 25 is blocked from forced retraction.

Due to this novel arrangement, a relatively small back-to-back positioning cylinder assembly 25 may be employed, thereby providing an abundance of free space about the top of the mill entry guide mechanism 10 for easy access and maintenance and for the accommodation of accessory equipment.

Positioning or drive cylinder 25 has considerably less clamping drive force on upper platen 12 than does air chamber 50. Because of the shallow yet wide construction of air chamber 50, this air chamber has an effective pressure application area against upper platen 12 for clamping which increases possible clamping forces to over 260 percent of that which could be realized by conventional prior art mill entry guides. Generally, an air pressure within air chamber 50 of approximately 60 to 100 p.s.i. is sufficient to create such clamping forces.

In addition, the yieldable characteristics of seal member 51 provide a back-up cushioning for upper platen 12 when the strip is clamped between platens 12 and 13. During clamping in tailing-out operations, the mill is slowed down such that the strip is usually traveling between 100 to 1,000 feet per minute.

Lower platen 13 is positioned such that its upper clamping surface 55 is aligned with the mill pass line 14 by conventional vertical positioning jacks driven by air motors (not shown). Both upper platen 12 and lower platen 13 are also lined with upper platen boards 56 and lower platen boards 57 respectively. These platen boards are provided for frictional clamping engagement with a strip workpiece passing between the platens.

These platen boards each have two beveled surfaces 58 and 59 which are spaced from each other and mate corresponding beveled surfaces 60 and 61 on their respective platens thereby retaining the boards to the platens in a bevel keyed fashion. Releases 62 are provided on the top platen 12 and releases 63 are provided on the bottom platen 13 to temporarily permit displacement of the aforesaid mating beveled surfaces 58, 60 and 59, 61 for removal or insertion of any selected one of the platen boards 56 or 57. Upper releases 62 for platen boards 56 consist of T-handles which are turnable to threadably back-off beveled surface 61 of the upper platen thereby permitting the platen board 56 to be dropped out of keyed engagement with its platen. This operation is readily performed when the top platen is partially lowered.

Lower platen board releases 63 consist of keeper plates which are secured to the lower platen 13 and positioned to engage or retain the ends respectively of the platen boards to retain them in keyed engagement with platen 13. Keeper plates 63 are pivotally movable about their center bolts 64 which retain them to lower platen 13 so that the upper retaining lip 65 of the keeper plates may be pivoted sideways to permit bottom platen boards 57 to be slid rearwardly or to the right as viewed in FIG. 1 thereby disengaging mating beveled surfaces 58, 60 and 59, 61 so that the board may be removed from the platen. Keeper plates 63 are also counterweighted at their bottoms 66 to normally maintain them in engagement with the boards to retain them in keyed locking engagement with the bottom platen 13.

Platen board changes are required on the guides primarily when width changes are made for the strip being rolled. Board changes also have to be made when they show excessive wear and have to be replaced.

When a width change of the guides has to be made to accommodate strips of different widths, side guides 70 are adjustable inward or outward to accommodate the different strip widths by means of a conventional nut and screw drive consisting of nuts 71 threadably received on screws 72 which are driven from air motor 73 through the gear reduction drive box 74. Side guides 70 are secured to their respective drive nuts 71 and slidably engage lower platen 13.

I claim:

1. A mill entry guide mechanism including a support frame with upper and lower platens positioned to receive an elongated workpiece therebetween and drive means movably supporting one of said platens from said frame for driven movement toward said other platen to clamp a workpiece therebetween, the improvement comprising second drive means disposed between said first drive means and said one platen to further drive said one platen into heavier clamping engagement with the workpiece after clamping engagement has been effected by said first drive means, and lock means extending between said second drive means and said frame and engageable to block said first drive means against forced retraction by said second drive means.

2. The mill entry guide mechanism of claim 1 wherein said second drive means consists of an expansible air chamber with means to inject air under pressure thereinto.

3. The mill entry guide mechanism of claim 2 wherein said first drive means is an air cylinder having less drive force than said second drive means.

4. The mill entry guide mechanism of claim 3 wherein said expansible air chamber is shallow and wide such that it has a larger effective pressure application area against said one platen than does said air cylinder.

5. The mill entry guide mechanism of claim 4 wherein said air chamber is yieldable to provide back-up cushioning for said one platen.

6. The mill entry guide mechanism of claim 1 wherein said lock means consists of lever arms pivotally supporting and guiding the movement of said one platen in swing fashion relative to said frame and positioned such that said lever arms are pivoted to locking dead center parallel alignment relative to the direction of the drive force applied by said second drive means between said one platen and said levers when said platens are in clamping engagement with the workpiece thereby mechanically blocking said first drive means from forced retraction when said second drive mechanism is driven.

7. The mill entry guide mechanism of claim 1 including platen boards temporarily retained by a beveled key fit to at least one of said platens and release means on said platen to unkey and permit removal of said platen boards.

8. A mill entry guide mechanism comprising, a support frame, upper and lower platens supported by said frame to receive elongated strip passing therebetween, said upper platen supported from said frame on opposite sides by lever arms for guided swing movement from an open position spaced above said lower platen downwardly to a closed position with said upper and lower platens clamping said strip therebetween, a drive cylinder connected between said support and said upper platen and extendable to drive said upper platen to said closed position, drive means disposed between said drive cylinder and said upper platen to further drive said platen in said closed position into heavier clamping engagement with said strip, said lever arms positioned and aligned such that when said upper platen is in said closed position said lever arms are aligned at locking dead center parallel alignment relative to the direction of drive force applied by said drive means between said upper platen and said levers when said upper platen is in said closed position to mechanically block said drive cylinder in extended position from forced retraction when said drive means is driven.

9. The mill entry guide mechanism of claim 8 wherein said drive means is an expansible air chamber with means to inject air thereinto under pressure.

10. The mill entry guide mechanism of claim 9 wherein said drive cylinder is air powered and has less clamping drive force on said upper platen than does said air chamber.

11. The mill entry guide mechanism of claim 10 wherein said air chamber is yieldable to provide back-up cushioning for said upper platen.

12. The mill entry guide mechanism of claim 9 wherein said expansible air chamber is a shallow and wide piston and cylinder arrangement defining the top and bottom of said chamber with a resilient endless seal member therebetween defining the sides of said chamber.

13. The mill entry guide mechanism of claim 12 wherein said drive cylinder is an air cylinder having less than a 24 inch cylinder bore.

14. A mill entry guide mechanism including a support frame with upper and lower platens having removably attached platen boards and positioned to receive and clamp an elongated workpiece therebetween, said platen boards of at least one of said platens each having two beveled surfaces spaced from each other and mating corresponding beveled surfaces on its platen thereby retaining said boards to said platen in a bevel keyed fashion, and release means releasable to temporarily permit displacement of said mating beveled surfaces for removal or insertion of platen board, said release means consisting of a keeper plate secured to said platen and positioned to engage an end of one of said boards to retain it in keyed engagement with its platen, said keeper plate pivotally movable to release said board and counterweighted to normally maintain engagement with said board.

15. A method of clamping an elongated workpiece between two platens in a mill entry guide comprising the steps of driving one of the platens with a first drive mechanism toward the other into clamping engagement with the workpiece which is positioned between the platens, locking said first drive mechanism in this clamping position to prevent its forced retraction therefrom, and further driving said one platen into heavier clamping engagement with the workpiece with a second drive mechanism disposed between said locked first drive mechanism and said one platen.

16. The method of claim 15 wherein the step of further driving said one platen is carried out by injecting air under pressure into an expansible air chamber as said second drive mechanism.

17. The method of claim 15 wherein the step of locking is carried out by pivoting swing levers which support said one platen to a position of locking dead center parallel alignment relative to the direction of the drive force applied by said second drive mechanism to said one platen thereby mechanically blocking said first drive mechanism from forced retraction when said second drive mechanism is driven.

* * * * *